United States Patent [19]

Bubik

[11] 4,212,374

[45] Jul. 15, 1980

[54] VEHICLE HOIST

[75] Inventor: Leslie Bubik, Toronto, Canada

[73] Assignee: Vulcan Equipment Company Limited, Toronto, Canada

[21] Appl. No.: 889,587

[22] Filed: Mar. 23, 1978

[30] Foreign Application Priority Data

Feb. 17, 1978 [CA] Canada ..... 297202

[51] Int. Cl.[2] ..... B66F 7/10

[52] U.S. Cl. ..... 187/8.43

[58] Field of Search ..... 187/8.41, 8.43, 8.47, 187/8.54, 17, 20, 23

[56] References Cited

U.S. PATENT DOCUMENTS

| | | | |
|---|---|---|---|
| 2,827,979 | 3/1958 | Thompson | 187/8.41 |
| 3,877,548 | 4/1975 | Hernick | 187/8.54 |
| 3,958,664 | 5/1976 | Perkins | 187/8.47 |
| 4,084,790 | 4/1978 | Malnar | 187/8.47 |

FOREIGN PATENT DOCUMENTS

| | | | |
|---|---|---|---|
| 470742 | 2/1974 | Australia | 187/8.41 |

*Primary Examiner*—Robert R. Song

*Attorney, Agent, or Firm*—Sughrue, Rothwell, Mion, Zinn and Macpeak

[57] ABSTRACT

A vehicle hoist is provided with improved access to the vehicle in which a ramp section is raised on two vertical posts. The ramp section constitutes a first lifting mechanism and a second lifting mechanism is provided in the ramp section deck to raise the vehicle wheels clear to permit work to be done without removing the vehicle. The relative attitude between the ramp section and the vertical posts, i.e., vertical to horizontal, is maintained by a guide means which travels through a limited arc relative to a horizontal axis to react with the vertical columns and maintain the ramp section horizontal. The vertical posts are also restrained from inward movement by spacer rollers on the ramp section which engage the adjacent faces of the vertical columns.

20 Claims, 9 Drawing Figures

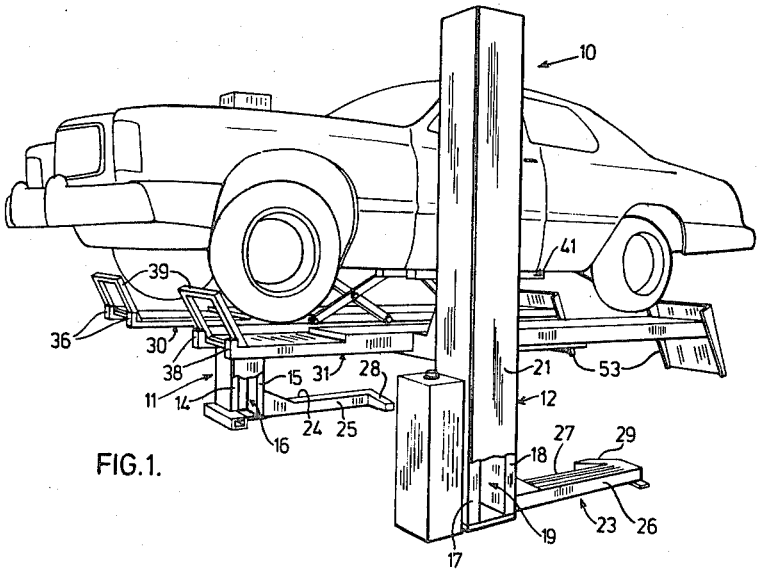
FIG.1.
FIG.4.
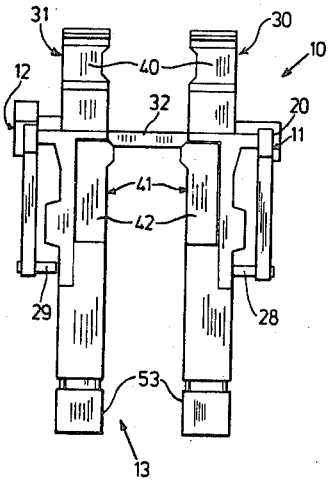
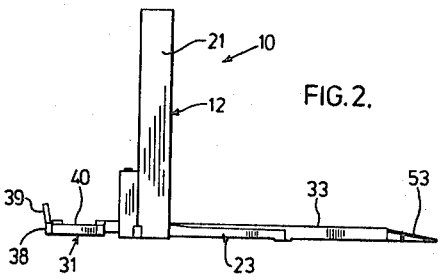
FIG.2.
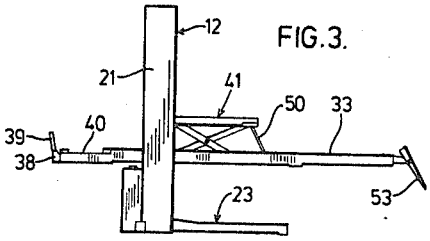
FIG.3.

FIG.8.
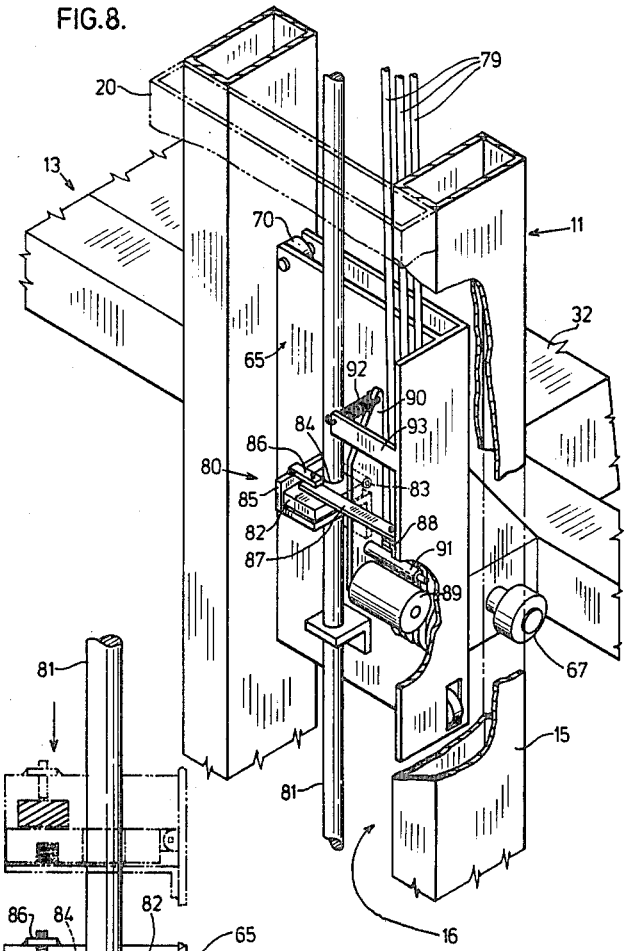
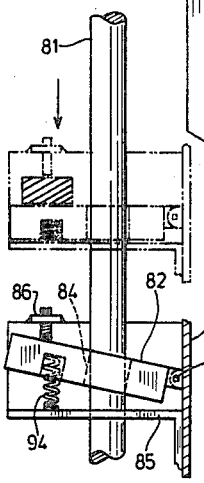
FIG.9.

VEHICLE HOIST

This invention relates to vehicle-lifting hoists and more particularly to such hoists as are known as two-post hoists.

In the vehicle repair art, it was initially the custom to provide access to the underside of vehicles from pits over which the vehicle was driven. Then, more sophisticated hoisting equipment was introduced. Such equipment was normally comprised of one or more hydraulically operated posts which were provided on their upper ends with arms which moved through horizontal planes to engage with the frames of the vehicles to be raised. These hoists were generally known as "in-ground" hoists and whilst relatively economical were expensive to install and limited the access to the vehicle and the service bays.

Apart from considering vehicle hoists as "in-ground" and "above-ground," such hoists may be classified in accordance with the number of supporting columns employed, one, two or four post hoists.

However, these hoists of the past have in the main presented problems either with respect to their capital cost, installation cost, lack of access to the underside of the vehicle, or in the number of tasks which can be performed on the hoist.

Such prior art structures are illustrated in the following patents of which the inventor is aware:

U.S. Pat. No. 2,827,979—Thompson—Mar. 25, 1958
U.S. Pat. No. 2,593,635—Walker—Apr. 22, 1952
U.S. Pat No. 2,062,549—Wold—Dec. 1, 1936
U.S. Pat. No. 2,736,104—Sherman—Feb. 28, 1956
U.S. Pat. No. 3,750,899—Greer—Aug. 7, 1973
U.S. Pat. No. 3,985,207—Petit—Oct. 12, 1976

Most hoists have limited access to the underside of the vehicle, single-post hoists are centrally located and the supporting arms, as shown in U.S. Pat. No. 2,062,549, prevent access.

Some two-post hoists such as U.S. Pat. No. 2,593,635, with arms which engage the frame require adjustment to engage the frame, provide limited access to the underside and permit limited access to the vehicle itself. In other words, two-post hoists are generally not acceptable because they are difficult to get in and out of once the vehicle is positioned on them.

However, all two-post hoists have in the past, whether or not the access to the underside of the car is relatively free, required cross members between the upper ends of the posts, see U.S. Pat. Nos. 3,750,899, 2,827,979 and 2,593,635. These cross members limit the height to which the vehicle may be raised.

In accordance with the present invention and with the object of providing an economical vehicle hoist which is easy to install, maintain and which will permit almost unlimited access to the underside of a vehicle, there is provided in accordance with the present invention a novel vehicle hoist. This vehicle hoist comprises a pair of vertical posts which are disposed one on either side of the vehicle to be raised. These vertical posts have forwardly extending feet. Between the posts a wheel-engaging ramp section is provided. The ramp section comprises a pair of ramp members which are connected by a transversely extending cross beam which, while serving to connect the two ramp members, also serves to space the two vertical posts. The individual ramp members include a pair of secondary platforms engageable with the frame which can be raised and lowered to raise the vehicle off the ramp members to permit wheel and brake work to be done. The ramp section is raised by a piston and cylinder, an a pulley and rope arrangement such that the ramp section moves vertically in parallel with the ground.

These various features and their advantages will be more fully understood from the following description and drawings in which a specific embodiment is described by way of example and in which:

FIG. 1 is a general perspective view of a vehicle hoist in accordance with the present invention with a vehicle thereon in a raised position;

FIG. 2 is a side elevation of a vehicle hoist in accordance with the present invention in a lowered position;

FIG. 3 is a side elevation of the vehicle hoist illustrated in FIG. 2 in an elevated position;

FIG. 4 is a plan view of a vehicle hoist in accordance with the present invention;

FIG. 8 is a perspective view, partially broken away, of a left-hand vertical column and illustrates a means for maintaining the ramp horizontal and a safety mechanism for maintaining the ramp in the raised position in the event of pressure failure in the hydraulic system; and FIG. 9 is a diagrammatic illustration in side view of the operation of the safety mechanism of FIG. 8.

Figure 5:
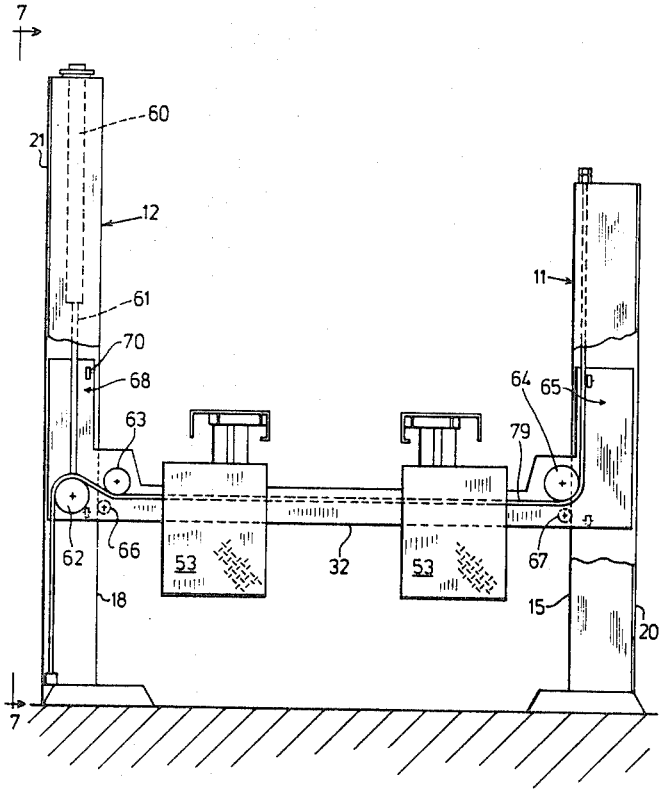
FIG. 5 is an end elevation, partially broken away, of a hoist in accordance with the present invention and serves to illustrate the relationship of the lifting mechanism to the ramp and posts.
Figure 6:
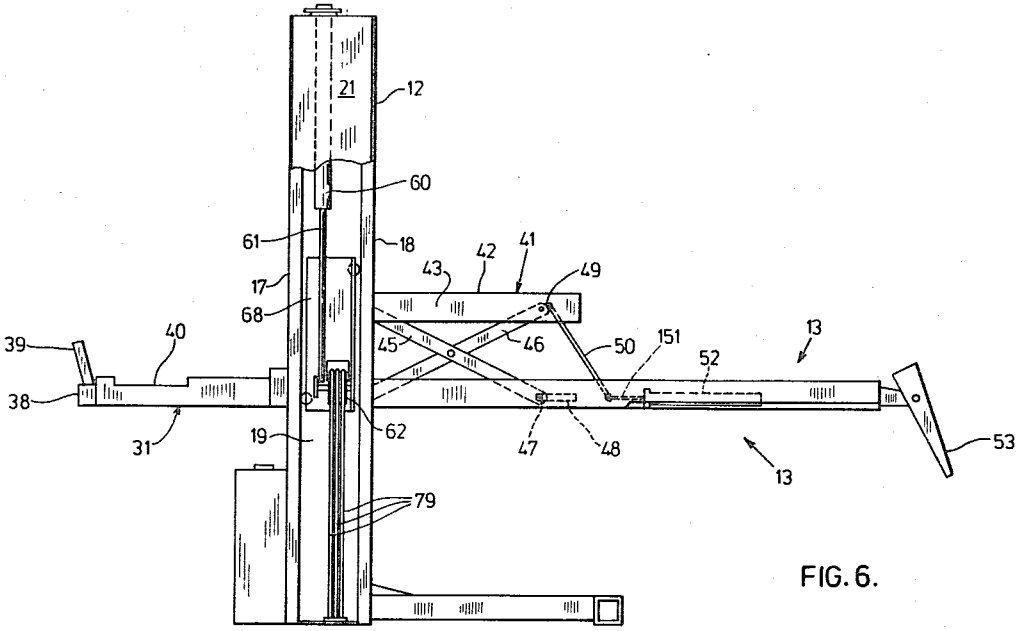
FIG. 6 is a side elevation, partially broken away, taken along line 7—7 of FIG. 5 and again serves to illustrate the relationship between the ramp and posts.

Referring now to the drawings, a hoist in accordance with the present invention is generally indicated at 10. The hoist 10 comprises a pair of vertical columns 11 and 12 which are disposed one on either side of a ramp section generally indicated at 13. For convenience, columns 11 and 12 will be referred to as the right-hand and left-hand columns, respectively. Column 11 comprises a pair of spaced-apart vertically extending rectangular steel members 14 and 15 which define an inwardly facing channel 16. Column 12 similarly comprises members 17 and 18 defining an opposed inwardly channel 19 to channel 16. The outer opening of channels 16 and 19 may be closed by a plate or further rectangular member such as 20 and 21, secured in any suitable manner.

From the bottom of each of columns 11 and 12 a ground-engaging foot 22, in the case of column 11, and 23 in the case of column 12 extend. Foot 22 comprises a pair of rectangular channel members 24 and 25 rigidly welded to the base of column 11 in the manner shown. Foot 23 similarly comprises channel members 26 and 27 similarly secured to the base of column 12. And from the back of the vertical columns 11 and 12 and at the base thereof a further pair of ground-engaging members 28 and 29 extend inwardly, as shown.

In the preferred embodiment the total effective length of the ramp section is approximately 168" whereas the distance from the rear limit of members 28 and 29 to the forward limit of the ground-engaging feet 22 and 23 is approximately 62". It is also to be noted that the rearward extent of the ramp sections is approximately 36" beyond the rearward extent of the vertical columns 11 and 12.

In this specification the terms forward and rearward are used with reference to the vertical columns and with reference to the travel of a vehicle to be raised on the hoist.

It will be apparent from the dimension referred to, although these are not to be considered limiting, that the relationship of the posts and the ramp sections that the centre of gravity of all presently available passenger automobiles will fall within the outer limits of the feet and post dimensions.

As mentioned previously, between columns 11 and 12 a ramp section 13 is mounted. Ramp section 13 comprises a pair of ramp members 30 and 31 connected by a transversely extending channel member 32 in alignment with the vertical channels 16 and 19 in the vertical columns 11 and 12. Each ramp member is the mirror image of the other and comprises an upper deck 33 with depending side walls such as 34 and 35. At the forward end of each ramp member a pair of channels 36 and 38 are provided to receive the legs of a removable U-shaped stop indicated at 39 and adjacent the front end a downwardly stepped recess 40 is provided. These recesses 40 will receive turn plates so that wheel alignment may be effected without removing the vehicle from the hoist.

Figure 7:
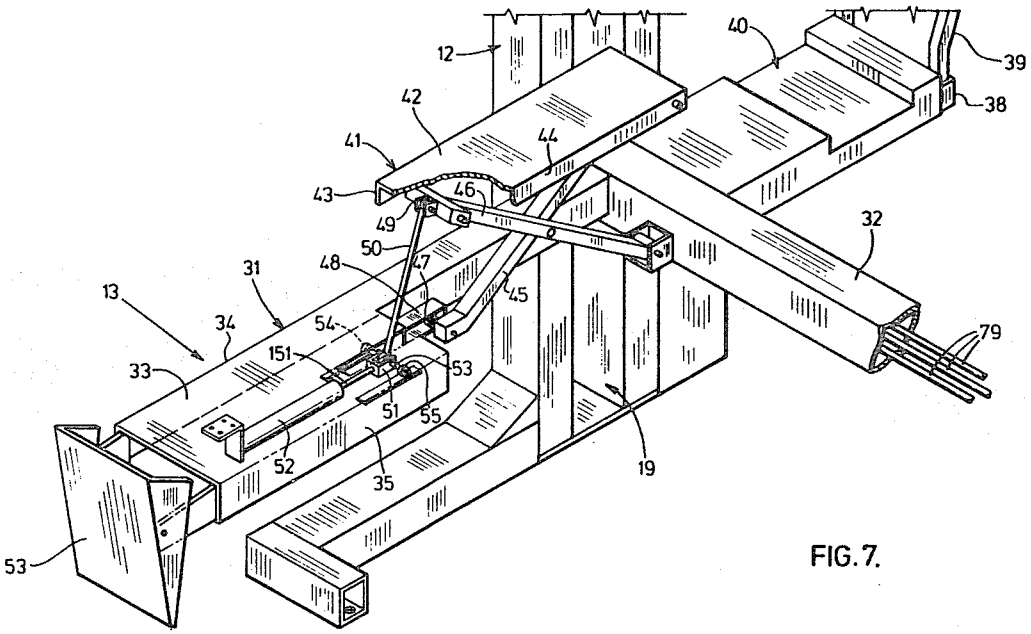
FIG. 7 is an enlarged view, partially broken away, of one ramp member in an elevated position and serves to illustrate the relationship of a secondary lifting mechanism in accordance with the present invention and the ramp member.

Rearward of recess 40 on each upper deck a secondary lifting platform 41 is provided. Platform 41 comprises a deck 42 which in a lowered position is normally flush with the upper deck 33 of its respective ramp member. From deck 42 again a pair of depending side walls 43 and 44 extend. To these side walls the upper ends of a pair of scissor arms 45 and 46 are pivotally mounted with the pivotal mounting of the upper end of arm 46 being slidable in slots (not shown) in the walls 43, 44. The lower end of arm 46 is pivotally connected, as shown in FIG. 7, to the transverse channel member 32. The lower end of arm 45 is provided with a roller 47 which moves along a channel 48. The upper end of arm 46 is also pivotally connected at 49 to the upper end of arm 50. The lower end of arm 50 is connected through bracket 51 to rod 151 of cylinder 52, and rod 53 to rollers 54 and 55. Rollers 54 and 55 run in the guides as illustrated.

Cylinder 52 is mounted on the underside of deck 33 and is connected with a source of fluid power in the conventional manner by hydraulic fluid lines.

At the rear end of each of the ramp members 30 and 31 a drive-on ramp member 53 is provided. Each drive-on ramp member 53 is hinged intermediate its length so that once the ramp section starts to rise, the rear end of the ramp members start to fall and provide an automatic stop to prevent the vehicle from rolling off the ramp members.

To the top of the right-hand column 11 a cylinder 60 is secured with its piston 61 extending downwardly into the vertical channel 19. The lower end of piston 61 is connected to a channel guide member 68 upon which a large sheave 62 is rotatably mounted. Channel guide member 68 is in turn secured to the left-hand end of cross member 32 and moves in channel 19. Within cross member 32, two sheaves 63 and 64 are rotatably mounted. Sheave 64 extends through a slot in a right-hand channel guide 65 which is secured to the right-hand end of cross member 32 and is free to move in channel 19 of column 11.

Cross member 32 is also provided with a pair of rollers such as 66 and 67, one on each lateral end, which rotatably engage the inner facing surfaces of one of each of the rear vertical members 15 and 18.

Channel guide member 68 comprises a pair of spaced-apart plates which extend above cross member 32. On the upper rear edge, that is the edge facing the ramp member end remote from recess 40, a roller 70 is provided. On the lower front edge a second roller or low friction plate may be provided. Channel guide 65 is provided with similar rollers.

As shown in FIG. 5, a series of cables 79, three in the preferred embodiment, are provided for raising and lowering the ramp section 13. These cables are anchored at the foot of the left-hand column 12 and to the uppermost end of column 11 in a conventional manner. These cables pass up from the base of column 12 over sheave 62, and under sheaves 63 and 64 in cross member 32 to be secured to the upper end of column 11.

On column 11 in channel 16 a safety mechanism, generally indicated as 80 in FIG. 8, is shown. As illustrated, it comprises a vertically extending safety rod 81 secured at upper ends of the vertical column 12. A plate 82 hinged at 83 and provided with a hole 84 therethrough is mounted so that the plate 82 surrounds rod 81. A bracket 85 limits the downward travel of plate 82 and an upper bar 86 limits the upper travel and serves to maintain a bar 87 in the normal operating position. Bar 87 is pivotally mounted on a bracket 88 and held in engagement between bar 86 and plate 82 by a spring 94. A roller 89 is rotatably mounted on an arm 90 below bar 87 in engagement with the cables 79. Arm 90 is pivotally mounted on shaft 91. Roller 89 is maintained in engagement with the cables 79 by a spring 92 mounted between the upper end of arm 90 and a bar 93 extending from the channel guide.

When there is a failure the loosening of tensioning in the cables causes roller 89 to move in, arm 90 moves around shaft 91. This shaft knocks bar 87 and plate 82 moves upward under the force of spring 94 and plate 82 binds on the rod 81 to restrain movement of the ramp members.

Operation

The vehicle to be inspected or repaired is driven onto the ramp section on ramp members 30 and 31 toward the rear of the hoist so that the front wheels are on recesses 40 or alignment turn plates which may be mounted therein.

The operator then actuates the ramp section 13 lifting mechanism through the controls 100. The piston and cylinder 60 and 61 are actuated so that the piston 61 is pulled upwards. Piston 61 being secured to guide 68 raises the guide and sheave 62 mounted thereon.

Since cables 79 are anchored at the bottom of column 12 and the top column 11, pass over sheaves 62 and under sheaves 63 and 64 across cross beam 32, the cables will move up with cross beam 32 and by virtue of the anchoring will maintain the ramp section 13 substantially horizontal.

As the car rises, the weight of the car and its position on the ramp section 13 will tend to cause the ramp section 13 to tilt forward and downward toward feet 23 and 24. This action causes the upper end of channel guides 65 and 68 to move in the same direction and their lower ends to move toward the rear of the hoist. The rollers 70 or the equivalent low-friction pads on the guides move into contact with the adjacent opposed walls of their respective guide channels and their interaction with the channel walls maintains the ramp section horizontal.

Simultaneously the weight of the vehicle causes the upper ends vertical columns 11 and 12 to tend to move inward toward each other, however, as the ramp section 13 moves relative to the vertical column, the rollers 67 on cross beam 32 in contact with the adjacent column wall will react therewith and counter this tendency so that the columns are maintained substantially vertically.

When the vehicle has been raised to the desired height the cylinder and piston are locked in position by conventional means and the safety mechanism, the structure and operation of which have been previously described, will be maintained at the ready to lock in the event of possible cable failure.

It will be seen that the ramp section 13 may be moved to any desired height and will accommodate any height of vehicle. The relationship between the cable and the cross bar ensures that the operator's feet are not hampered; the relationship between the cross beam 32 and the ramp sections 30 and 31, i.e., the requirement of only one cross member, permits easy access to the vehicle; and the absence of a transverse beam across the top of the posts permits the vehicle to be raised to almost any height without limitation due to the height of the vehicle. It will also be noted that the relative position of the vertical columns 11 and 12 relative to the vehicle on the ramp section permit the car doors to be opened and entry and egress is relatively easy.

However, after the initial elevation if wheel or brake work has to be done on the vehicle, it does not, with the present apparatus, have to be moved to a further bay or removed therefrom.

The secondary lifting platforms 41 are raised by actuation of conventional controls which cause the pistons such as 151 of cylinder 52 to be extended. This extension then causes the scissor arms 45 and 46 to move toward the front of their respective ramps and the decks 42 will be raised from their position flush with the upper deck 33 of the ramp members. As decks 42 rise they engage the vehicle frame and raise the vehicle. This action is of course continued until the vehicle wheels are free of the upper decks and work may be performed thereon. The lowering of the secondary platforms 43 and the ramp section 13 is accomplished merely by reversing the controls.

From the foregoing it will be seen that a hoist with unique capabilities has been provided. It will of course be understood that other modifications may be made thereto without departing from the scope of the claims hereafter set forth.

The embodiments of the invention in which an exclusive property or privilege is claimed are defined as follows:

1. A vehicle hoist which comprises a pair of ground-engaging feet extending in a spaced-apart parallel relationship, said feet each having a front end and a substantially vertical column extending upwardly therefrom adjacent said front end, a ramp section for receiving a vehicle to be raised and movably supported between said columns for vertical motion in a substantially horizontal attitude, said ramp section comprising a pair of spaced-apart ramp members extending forwardly and rearwardly beyond said columns and second vehicle lifting means, said second vehicle lifting means comprising a vehicle-engaging member having an upper surface normally flush with an upper deck of a respective ramp member and means for moving said vehicle-engaging member substantially vertically, a transverse cross member extending between said ramp members in alignment with said columns, said cross member extending beyond said ramp members and having guide means engageable with said columns, and spacer means for maintaining a substantially constant relationship between said ramp section and said columns, and means for moving said ramp section relative to said columns.

2. A vehicle hoist as claimed in claim 1 wherein said vertical columns each provide an inwardly facing channel and said guide means of said ramp section is engageable therewith and movable therein.

3. A vehicle hoist as claimed in claim 2 wherein said guide means is movable through a limited arc about a horizontal axis in response to the weight of a vehicle thereon to maintain said ramp section in said substantially horizontal attitude.

4. A vehicle hoist as claimed in claim 1 wherein said means for moving said vehicle-engaging member substantially vertically comprises a pair of scissor legs pivotally connected between the respective ramp members and said upper deck, piston means for moving said scissor legs to move said upper deck vertically in a substantially horizontal attitude, and means for actuating said piston.

5. A vehicle hoist as claimed in claim 4 wherein said vehicle-engaging members operate together.

6. A vehicle hoist as claimed in claim 4 wherein said vehicle-engaging members operate together.

7. A vehicle hoist as claimed in claim 1 wherein said spacer means comprises a low-friction element on each of a lateral side of said ramp section between said ramp section and an adjacent column, said low-friction element being movable with said ramp section.

8. A vehicle hoist as claimed in claim 7 wherein said low-friction element is a pair of laterally extending rollers each abuttably engageable with an adjacent surface of their respective adjacent column.

9. A vehicle hoist as claimed in claim 1 wherein said means for moving said ramp section supports said ramp section between said columns.

10. A vehicle hoist as claimed in claim 9 wherein said means for moving said ramp section comprises a power source, a piston and cylinder, and means operatively connecting said piston and cylinder and said ramp section to move said ramp section vertically.

11. A vehicle hoist as claimed in claim 10 wherein said means for moving said ramp section includes a cable of constant length having first and second ends anchored at both ends and operatively connected intermediate its length to said cross member of said ramp section.

12. A vehicle hoist as claimed in claim 11 wherein said cross member includes a pair of sheaves mounted one at each end thereof, a movable sheave within one of said columns, said cable extending over said sheaves, said movable sheave being movable in response to actuation of said piston and cylinder.

13. A vehicle hoist as claimed in claim 9 wherein said ramp section is suspended between said columns.

14. A vehicle hoist as claimed in claim 13 wherein said means operatively connecting said piston and cylinder and said ramp section is a cable.

15. A vehicle hoist as claimed in claim 14 further including cable braking means engageable with said cable and responsive to a release in tension of said cable to restrain movement of said cable.

16. A vehicle hoist as claimed in claim 1 wherein said guide means is movable through a limited arc about a horizontal axis in response to the weight of a vehicle thereon to maintain said ramp section in said substantially horizontal attitude.

17. A vehicle hoist as claimed in claim 1 including movable spacer means disposed in abutting relationship between said ramp section and each vertical column.

18. A vehicle hoist as claimed in claim 17 wherein said spacer means comprises a pair of rollers.

19. A vehicle hoist as claimed in claim 17 wherein said ramp section further includes a cross member extending between and connected to said ramp members and said means for moving said ramp member includes a cable of constant length secured at either end thereof to one of each of said vertical columns, first pulley means for guiding said cable through said cross member, second pulley means for varying the relationship of said cable to said ramp member and piston means for moving said second pulley means.

20. A vehicle hoist as claimed in claim 19 further including cable braking means engageable with said cable and responsive to a release in tension of said cable to restrain movement of said cable.

* * * * *